United States Patent [19]

Lundvall II

[11] Patent Number: 4,992,698

[45] Date of Patent: Feb. 12, 1991

[54] COLOR PICTURE TUBE INCLUDING AN ELECTRON GUN WITH AN ELECTRODE HAVING AN OPTIMIZED ATTACHMENT MEANS

[75] Inventor: Carl L. Lundvall II, Lititz, Pa.

[73] Assignee: RCA Licensing Corp., Princeton, N.J.

[21] Appl. No.: 349,670

[22] Filed: May 10, 1989

[51] Int. Cl.[5] ..... H01J 29/46

[52] U.S. Cl. ..... 313/457; 313/417; 313/414

[58] Field of Search ..... 313/457, 417, 414

[56] References Cited

U.S. PATENT DOCUMENTS

| | | | |
|---|---|---|---|
| 3,659,134 | 4/1972 | Wanner | 313/82 |
| 3,701,920 | 10/1972 | Wanner | 313/292 |
| 4,049,991 | 9/1977 | Collins | 313/417 |
| 4,096,408 | 6/1978 | Bozzay et al. | 313/417 |
| 4,486,685 | 12/1984 | Hale et al. | 313/417 |
| 4,855,639 | 8/1989 | Van Eck | 313/417 |

OTHER PUBLICATIONS

Dynamic Astigmatism Control Quadra Potential Focus Gun for 21-in Flat Square Color Display Tube, by Katsuma et al. in SID Digest, 136 (12-1988).

*Primary Examiner*—Donald J. Yusko
*Assistant Examiner*—Diab Hamadi
*Attorney, Agent, or Firm*—Joseph S. Tripoli; Dennis H. Irlbeck; Vincent J. Coughlin, Jr.

[57] ABSTRACT

A color picture tube, includes an envelope having a faceplate panel and a tubular neck interconnected by a funnel. A three-color phosphor screen is formed on the interior surface of the faceplate and a multi-apertured color selection electrode is spaced from the screen. An electron gun is disposed within the neck of the tube. The electron gun includes three cathodes and a plurality of spaced-apart electrodes, having substantially aligned apertures therethrough, for generating and directing three electron beams along paths toward the screen. Each of the electrodes is secured to a plurality of longitudinally extending insulative support rods by at least two oppositely disposed, integral attachment elements, each having a distal end, a proximal end and an appendage portion therebetween. The distal end of each attachment elements includes a bifurcated portion including spaced-apart grasping members to facilitate attachment to the support rods. The distal end of each of the attachment elements of at least one electrode of the electron gun is improved over prior similar structures by being torsionally aligned at an acute angle relative to the longitudinally extending support rods. The grasping members of the distal end are symmetrically disposed with respect to the appendage portion to minimize the bending moment of the one electrode so as to reduce spacing variations and to substantially maintain aperture alignment between the one electrode and the adjacent electrodes.

5 Claims, 4 Drawing Sheets

Fig. 3
PRIOR ART
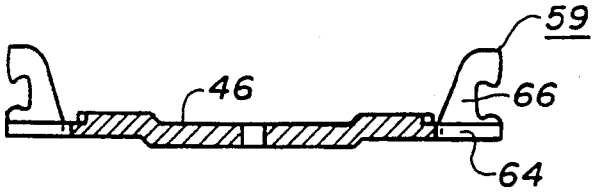
Fig. 6
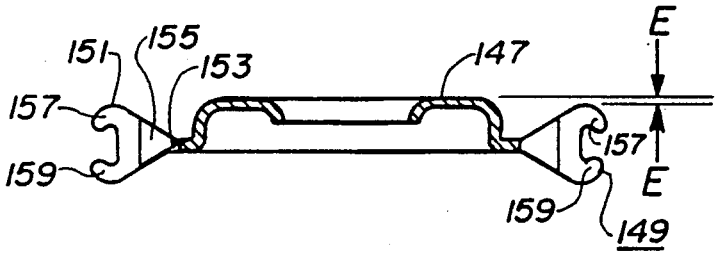
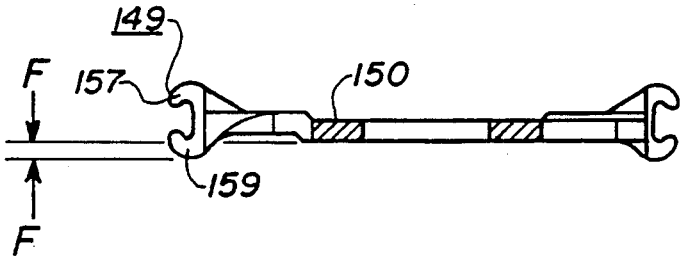
Fig. 7
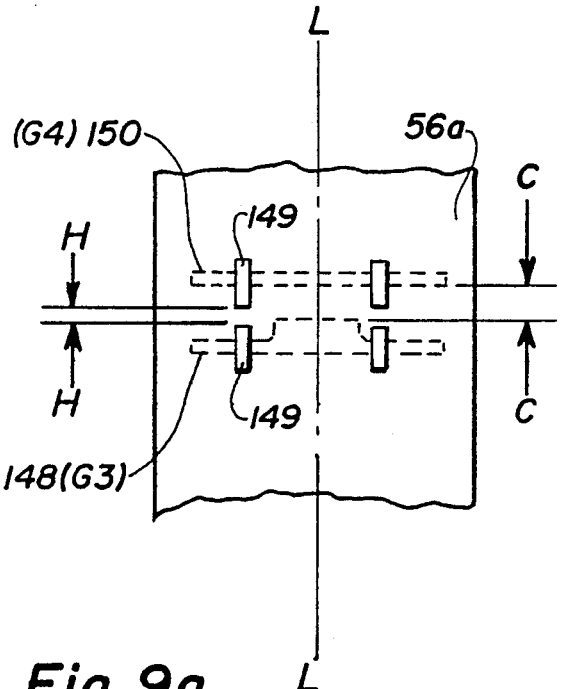
Fig. 9a
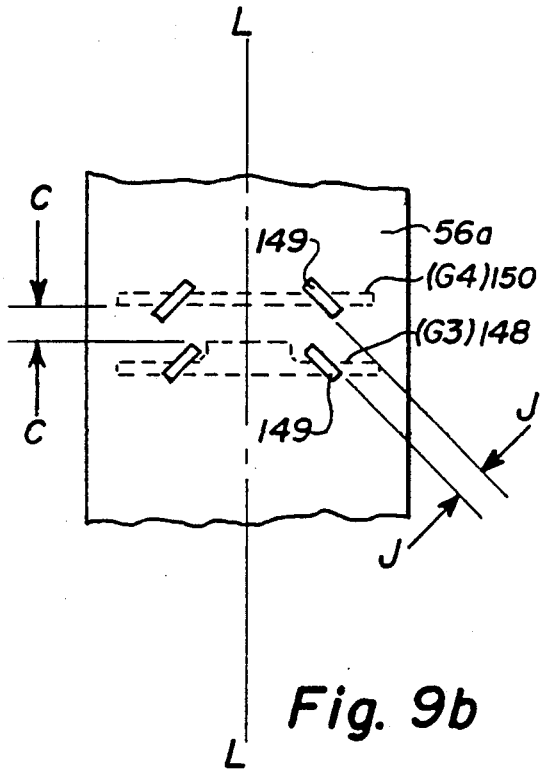
Fig. 9b

COLOR PICTURE TUBE INCLUDING AN ELECTRON GUN WITH AN ELECTRODE HAVING AN OPTIMIZED ATTACHMENT MEANS

BACKGROUND OF THE INVENTION

This invention relates to a color picture tube having an electron gun with a plurality of cathodes and apertured electrodes therein that produces three electron beams, and, more particularly, to an inline electron gun wherein at least one of the electrodes includes optimized attachment means for securing the electrode to a plurality of electrically insulative support rods so as to minimize the bending moment of the electrode, and for reducing the spacing variations between adjacent electrodes while maintaining the aperture alignment therebetween.

The electrode members of an inline electron gun assembly, such as that shown in FIG. 1, are serially arranged to accelerate and focus a plurality of electron beams along spaced, coplanar electron beam paths. The electrode members of the gun assembly are mechanically secured by attachment means and studs to at least a pair of insulative support rods which extend, longitudinally, along the beam paths. Each of the electrode members commonly has several spatially-related apertures formed therein to accommodate the respective electron beams generated within the electron gun. It is important that these several apertures be accurately located and aligned relative to the related apertures in adjacent electrode members, and to the respective electron generating surfaces. During the fabrication of the electron gun assembly, the attachment means and studs of the various electrode members are embedded into the temporarily heat-softened insulative support rods, at which time the support rods on opposed sides of the gun assembly are pressured inwardly toward the electrode members to force the attachment mean and studs into the support rods. The compressive pressure tends to exert a distorting force upon the electrode members of the electron gun assembly.

Co-pending U.S. Patent Application Ser. No. 325,840, filed on Mar. 20, 1989 by J. R. Hale and G. J. McCauley, entitled, STRENGTHENING MEANS FOR A SIDEWALL OF A CUP-SHAPED MEMBER FOR AN ELECTRON GUN OF A CRT discloses a structure for strengthening a deep-drawn cup-shaped electrode by forming coined, stud-securing areas in the sidewall of the electrode. It also is known in the art, for example in U.S. Pat. No. 4,049,991, issued on Sept. 20, 1977 to Collins, to strengthen a planar electrode member by forming strengthening bends and rib embossments in the planar surface of the member.

With recent utilization of large screen inline color CRT's for both CAD/CAM and entertainment applications, a reduced electron beam spot size over the entire screen is necessary for the high resolution requirements of such applications. Several electron guns which meet these high resolution requirements are described in the literature, for example, a six element (electrode) electron gun is described in an article entitled, DYNAMIC ASTIGMATISM CONTROL QUADRA POTENTIAL FOCUS GUN FOR 21-IN. FLAT SQUARE COLOR DISPLAY TUBE, by T. Katsuma et al. in SID Digest, 136 (1988). U.S. Pat. No. 4,877,998, issued on Oct. 31, 1988, also describes a six element electron gun having improved performance. Each of the above-mentioned electron guns requires a large number of closely spaced attachment claws embedded into the longitudinally extending insulative support rods of the electron gun such as those shown for the electron gun assembly of FIG. 1. A major drawback of such an electron gun structure is that/in the low voltage end of the electron gun assembly, i.e., in the vicinity of the G1 through G4 electrodes, the attachment claws are generally transversely disposed within the insulative support rods which are vulnerable to cracking due to stresses during tube processing (thermal stress during gun fabrication and high voltage stress during high voltage processing). One expedient, the formation of conventional vertically oriented attachment claws, attempts to minimize these stresses by orienting the claws along the longitudinal axes of the rods; however, the conventional vertical claws also include transversely disposed horizontal support tabs, as shown in FIG. 2, which tend to negate the advantage of the vertical portion of the claws (shown in FIG. 3) because the horizontal tabs also are embedded into the support rods. Another drawback of the vertically oriented attachment claws is that the offset of the claws with respect to the plane of the grid electrode introduces a bending moment during the fabrication operation, which causes spacing variations between the grid electrode with the vertical claws and adjacent electrodes, and contributes to aperture misalignment caused by movement of the subject electrode. Thus, a need exists for an improved attachment claw configuration that decreases the vulnerability to cracking of the support rods by eliminating the transversely disposed horizontal tabs while minimizing the bending moment of the grid electrode caused by the offset of the conventional vertical claw.

SUMMARY OF THE INVENTION

The color picture tube, according to the present invention, includes an envelope comprising a faceplate panel and a tubular neck interconnected by a funnel. A three-color phosphor screen is formed on the interior surface of the faceplate and a multi-apertured color selection electrode is spaced from the screen. An electron gun is disposed within the neck of the tube. The electron gun includes three cathodes and a plurality of spaced-apart electrodes, having substantially aligned apertures therethrough, for generating and directing three electron beams along paths toward the screen. Each of the electrodes is secured to a plurality of longitudinally extending electrically insulative support rods by at least two oppositely disposed, integral attachment means, each having a distal end, a proximal end and an appendage portion therebetween. The distal end of each attachment means includes a bifurcated portion comprising spaced-apart grasping members to facilitate attachment to the support rods. The distal end of each of the attachment means of at least one electrode of the electron gun is improved over prior similar structures by being torsionally aligned at an acute angle relative to the longitudinally extending support rods. The grasping members of the distal end are symmetrically disposed with respect to the appendage portion, to minimize the bending moment of the one electrode, so as to reduce spacing variations and to substantially maintain aperture alignment between the one electrode and adjacent electrodes.

Figure 2:
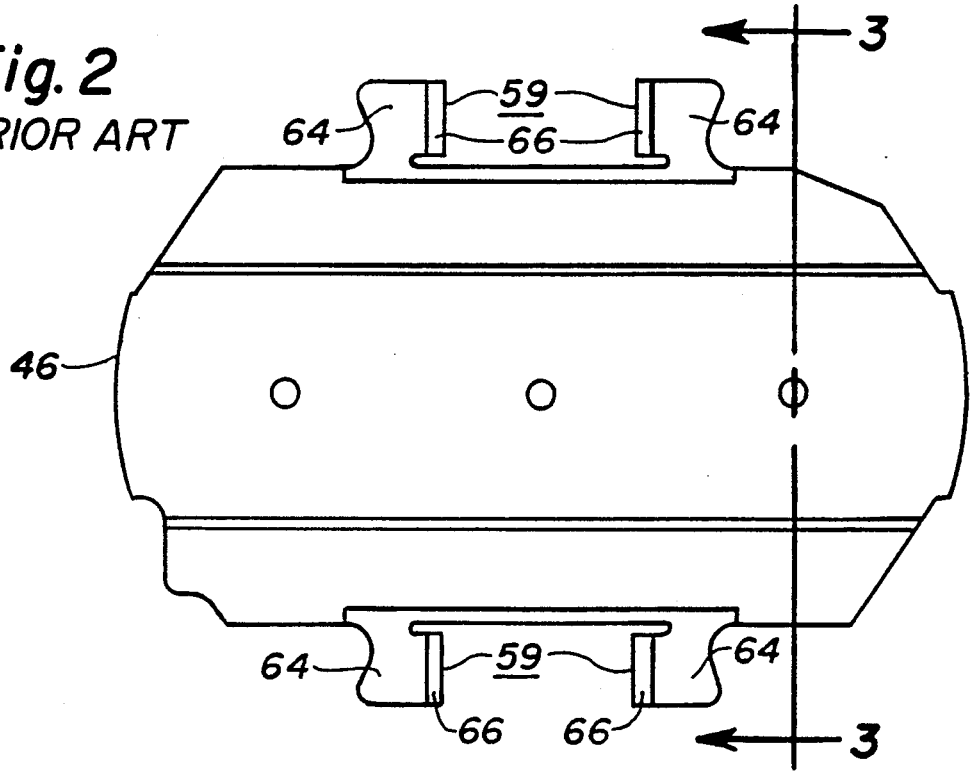
Fig. 2 PRIOR ART
FIG. 2 is plan view of an electrode having conventional vertical claws with horizontal support tabs.

FIG. a sectional view taken along line 3—3 of FIG. 2.

Figure 4:
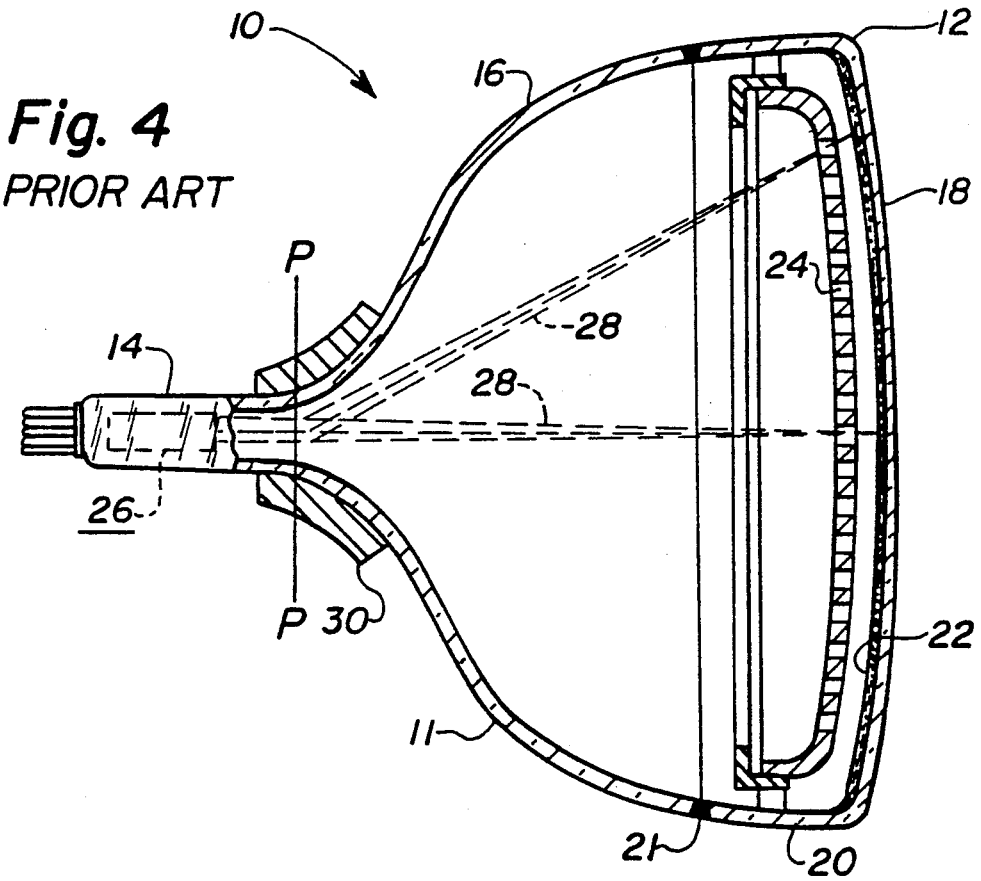
Fig. 4 PRIOR ART

FIG. 4 is plan view partially in axial section of a conventional color picture tube.

Figure 5:
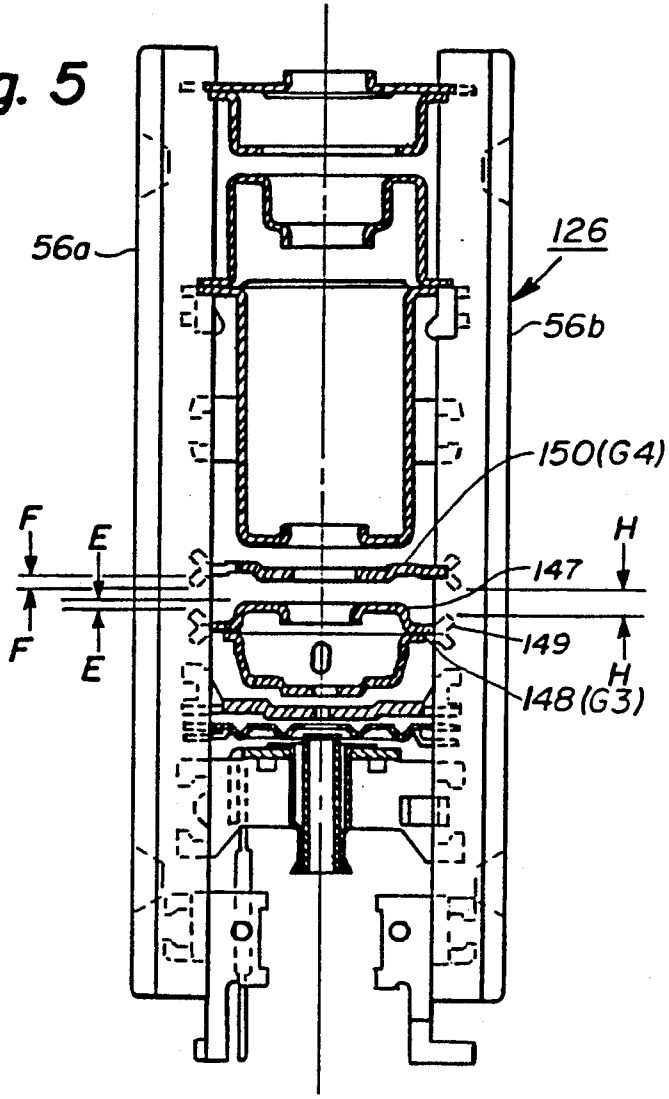

FIG. 5 is an axial side view of a six-electrode electron gun according to the present invention.

FIG. 6 shows the novel attachment means for a drawn electrode.

FIG. 7 shows the novel attachment means for a planar electrode.

Figure 8A:
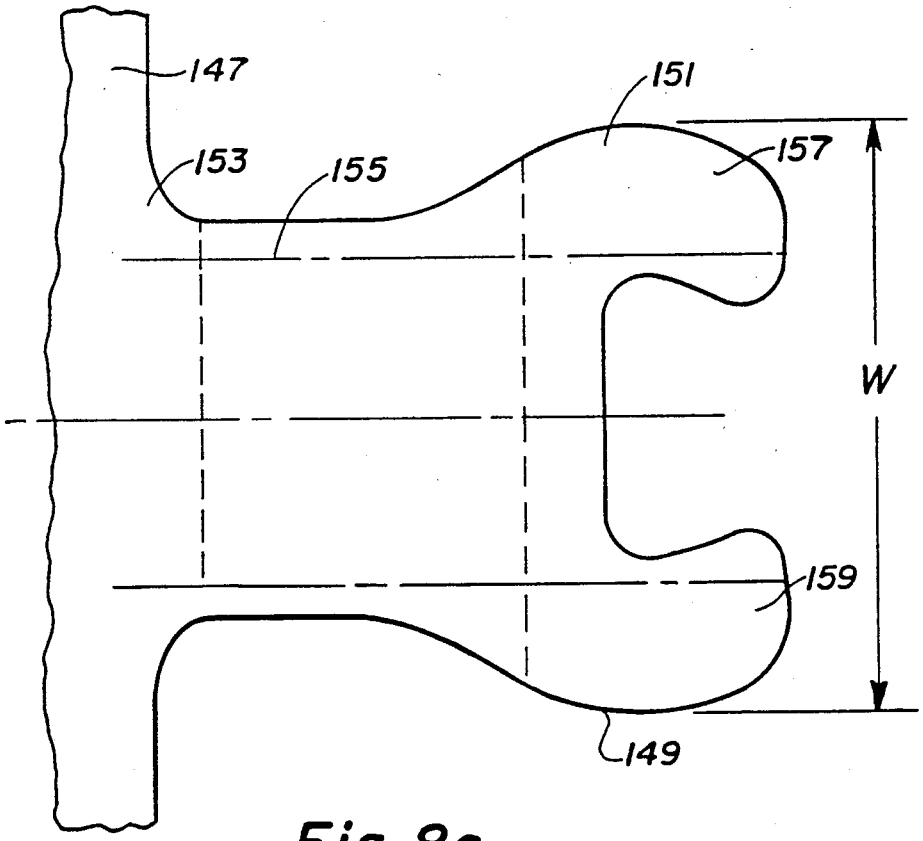
Figure 8B:
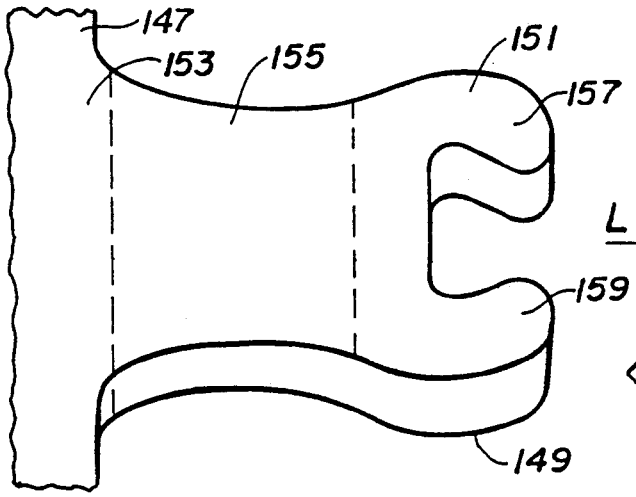
Figure 8C:
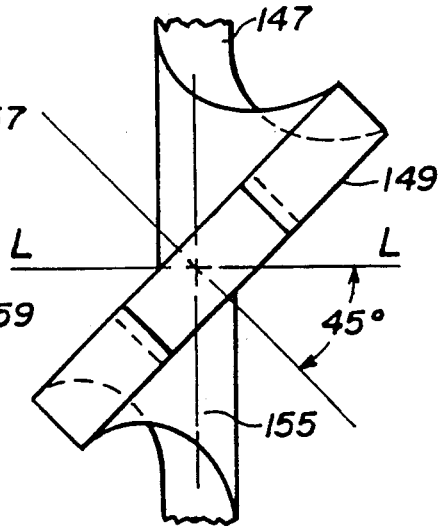

FIGS. 8*a*, 8*b*, and 8*c* show, respectively, a fragmentary side view of the attachment means during a step in the manufacturing procedure, a fragmentary side view after torsional forming, and a top view of the torsionally formed attachment means.

FIGS. 9*a* and 9*b* show, respectively, the relative spacing between adjacent torsionally aligned attachment means oriented longitudinally, and obliquely, with respect to the insulative support rods of the electron gun.

DETAILED DESCRIPTION OF THE PREFERRED EMBODIMENT

FIG. 4 shows a conventional rectangular color picture tube 10 having a glass envelope 11 comprising a rectangular faceplate panel 12 and a tubular neck connected by a rectangular funnel 16. The panel 12 comprises a viewing faceplate 18 and a peripheral flange or sidewall 20 which is sealed to the funnel 16 by a frit seal 21. A mosaic three-color phosphor screen 22 is located on the interior surface of the faceplate 18. The screen preferably is a line screen with the phosphor lines extending substantially perpendicular to the high frequency raster line scan of the tube (normal to the plane of the FIG. 4). Alternatively, the screen could be a dot screen. A multi-apertured color selection electrode or shadow mask 24 is removably mounted, by conventional means, in predetermined spaced relation to the screen 22. An inline electron gun 26, shown schematically by dashed lines in FIG. 4, is centrally mounted within the neck 14 to generate and direct three electron beams 28 along initially coplanar beam paths through the mask 24 and toward the screen 22. One type of electron gun that may be used is a six-electrode electron gun such as that shown in FIG. 1 and described in copending U.S. Patent Application, Ser. No. 263,454, identified above and incorporated by reference herein for the purpose of disclosure.

The tube of FIG. 4 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 4 at about the middle of the yoke 30. Because of fringe fields, the zone of deflection of the tube extends axially from the yoke 30 into the region of the gun 26. For simplicity, the actual curvature of the deflected beam paths in the deflection zone is not shown in FIG. 4.

Figure 1:
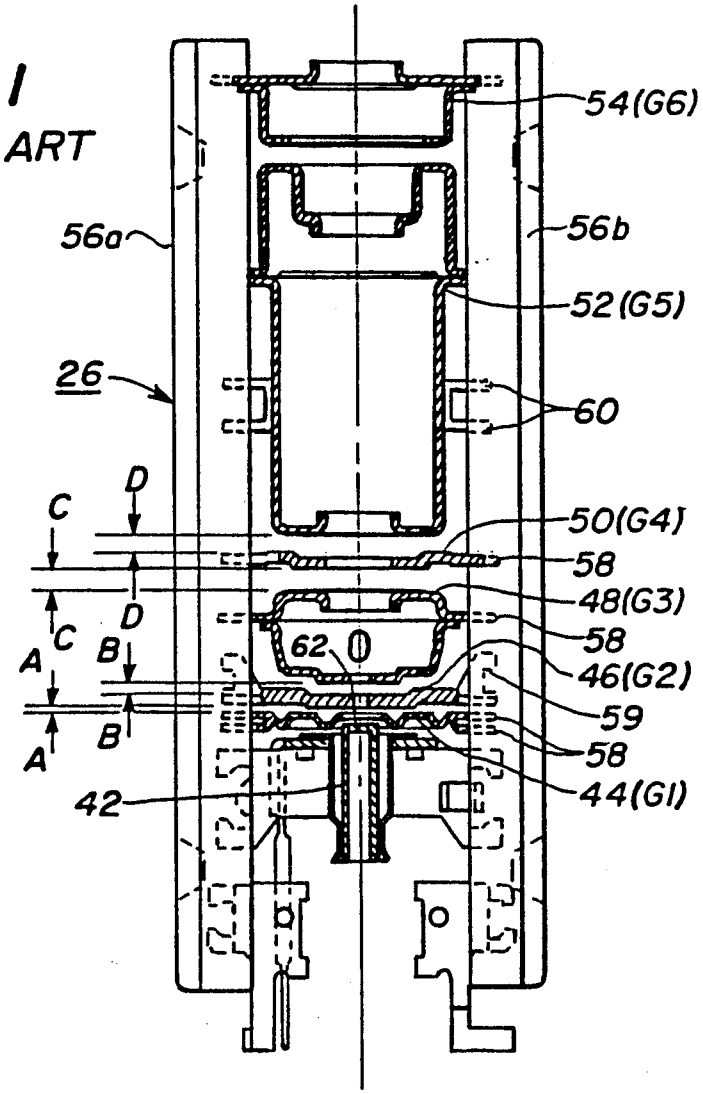
Fig. 1 PRIOR ART
FIG. 1 is an axial side view of a conventional six-electrode electron gun.

The electron gun 26 of FIG. 1 comprises three equally spaced, coplanar cathodes 42, one for each beam (although only one is shown), a control grid electrode 44 (G1), a screen grid electrode 46 (G2), a third electrode 48 (G3), a fourth electrode 50 (G4), a fifth electrode 52 (G5), and a sixth electrode 54 (G6). The electrodes are spaced in the order named from the cathodes and are attached to a pair of longitudinally extending, electrically insulative support rods **56*a* and 56*b* by a plurality of attachment means including horizontal claws 58, vertical claws 59 and tabs 60. Heaters, not shown, indirectly heat electron emissive substrate 62 formed on the cathodes 42**.

The cathodes 42, the G1 electrode 44, the G2 electrode 46 and a portion of the G3 electrode 48, facing the G2 electrode, comprise the beam-forming region of the electron gun 26. Another portion of the G3 electrode 48, the G4 electrode 50, and the proximate portion of the G5 electrode 52 form an asymmetric lens. The electrodes in the beam-forming region and the asymmetric lens are closely spaced, for example, the longitudinal spacing "A" between the G1 electrode 44 and the G2 electrode 46 is 0.15 mm, the spacing "B" between the G2 electrode 46 and the adjacent surface of the G3 electrode 48 is 0.76 mm, and the spacings "C" and "D", between the G4 electrode 50 and the adjacent surfaces of the G3 electrode 48 and the G5 electrode 52 are 1.27 mm, in each instance. The proximity between the adjacent G1–G4 electrodes and their attachment claws 58 and 59 creates the possibility of cracking the support rods **56*a* and 56*b*, because of the stresses (mechanical and thermal) introduced into the support rods during the electron gun fabrication (beading) operation and subsequent tube processing and high voltage conditioning. In order to optimize the strength of the support rods, the attachment claws should not cut transversely across the rods, but should, if possible, be aligned along the longitudinal axes of the support rods. The present G2 electrode 46 has a vertical claw configuration; however, as shown in FIGS. 2 and 3, the vertical attachment claws 59 include horizontal support tabs 64 in addition to the vertically extending portions 66. The horizontal support tabs 64 are embedded into the support rods 56*a* and 56*b*, and induce the same stress as the horizontally disposed claws on the G1, G3 and G4 electrodes. Additionally, the vertical claw configuration of the G2 electrode 46 introduces a bending moment into the G2 electrode during the beading operation because of the relatively long lever arm of the vertically extending portion 66 which has a height, or extension, of about 2.29 mm above the horizontal surface of the support tab 64. It is clear that the conventional vertical claw configuration (with a height of 2.29 mm) cannot be used for the G3 and G4 electrodes 48 and 50**, respectively, because the interelectrode spacing between these electrodes (1.27 mm) is insufficient to provide electrical isolation of the adjacent claws within the support rods.

The present invention utilizes the structural advantage of having the attachment claws of at least one and preferably both of the G3 and G4 electrodes embedded within the support rods **56*a* and 56*b*** in a direction that does not cut across the rods, i.e., that is not transverse to the longitudinally extending rods. Preferably, the attachment claws are aligned substantially along the longitudinal axes of the support rods and the attachment claws are configured to minimize the bending moment of the G3 and G4 electrodes.

In the preferred embodiment of the novel electron gun 126, shown in FIG. 5, all elements are identical to the conventional electron gun 26 except the G3 and G4 electrodes 148 and 150 which have improved attachment means or claws as described hereinafter.

With respect to FIG. 6, a top portion 147 of the G3 electrode 148 includes a pair of oppositely disposed, substantially vertically oriented attachment claws 149 which are embedded into the support rods 56*a* and 56*b*, shown in FIG. 5. The vertical orientation of the claws 149 is shown in FIGS. 8*a*, 8*b* and 8*c*. The electrode portion 147 is formed by a series of conventional stamping, piercing and drawing operation as are known in the art. The claws 149 are integral with the top electrode portion 147 and initially lie in the plane of the electrode, as shown in FIG. 8*a*. Each of the claws 149 includes a distal end 151, a proximal end 153 which is integral with the main body of the electrode portion 147, and an appendage portion 155 extending therebetween. The distal end 151 includes a bifurcated portion comprising spaced-apart grasping members 157 and 159 which form a claw to facilitate attachment of the electrode within the support rods (not shown in FIG. 8). FIGS. 8*b* and 8*c* show the torsional forming of the claw 149. The distal end 151 of each claw 149 is rotationally formed while the electrode 147 is held in place and the appendage portion 155 of the claw 149 is twisted so that the claw 149 forms an acute angle with an axis L—L normal to the plane of the electrode. The axis L—L corresponds to the longitudinal axis of the support rods 56*a* and 56*b* (not shown in FIG. 8). Typically, the width "W" of the distal end 151 of each of the claws 149 is about 2.27 mm; however, the torsional rotation is controlled, as shown in FIGS. 6 and 8*c*, so that the grasping members 157 and 159 of the claws 149 are symmetrically disposed with respect to the appendage portion 155 and extend substantially equally above and below the plane of the electrode rather than only above the plane of the electrode as shown for the conventional vertical claw structure of FIG. 3. The distance "E" from the planar surface of the top portion 147 of the G3 electrode to the top of the grasping member 157 is about 0.28 mm, as shown in FIGS. 5 and 6.

With respect to FIG. 7, the G4 electrode 150 has improved attachment means or claws 149 substantially identical to those described with respect to the top portion 147 of the G3 electrode 148. One difference between the G4 electrode 150 and the top portion 147 of the G3 electrode is that the G4 electrode is a substantially planar member. The distance "F" from the planar surface of the bottom of the G4 electrode 150 to the bottom of the grasping member 159 is about 0.57 mm. Thus, the spacing "H", shown in FIG. 5, between the adjacent vertically aligned claws 149 in the adjacent G3 and G4 electrodes 148 and 150, respectively, is about 1.02 mm 0.04 inch). This spacing within the insulative support rods 56*a* and 56*b* (capable of withstanding 2 kV per mil at room temperature) is sufficient to stand off a voltage of about 80 kV which is well in excess of the voltage difference of about 6.5 kV which is operationally applied between the G3 and G4 electrodes.

FIGS. 9*a* and 9*b* schematically represent the spacing variations between the claws 149 of the G3 and G4 electrodes 148 and 150, for claws 149 torsionally (vertically) aligned along the longitudinal axis L—L of the support bead 56*a*, i.e., at an acute angle of 0°, and for the claws 149 torsionally aligned at an acute angle of about 45° with respect to the longitudinal axis L—L of the support bead 56*a*. For an interelectrode spacing "C" of 1.27 mm between adjacent surfaces G3 and G4 electrodes 148 and 150, the vertically aligned claws 149 are spaced a distance "H" of 1.02 mm apart; however,, if the claws 149 are obliquely oriented at an angle of about 45° for the same interelectrode spacing "C", the distance "J" between adjacent claws increases to about 2.24 mm. Acute angles of less than 45° are preferred in practicing this invention.

An advantage to the novel claw structure for each of the electrodes 148 and 150 is that the grasping members 157 and 159 of the distal end 151 are symmetrically disposed with respect to the appendage portion 155 of the claw 149 so as to minimize the bending moment of the electrodes 148 and 150 during the beading operation, thereby reducing spacing variations between the adjacent electrodes while substantially maintaining aperture alignment therebetween.

What is claimed is:

1. In a color picture tube including an envelope comprising a faceplate panel and a tubular neck interconnected by a funnel, a three-color phosphor screen on an interior surface of said faceplate and a multi-apertured color selection electrode spaced from said screen, an electron gun disposed within said neck, said electron gun including three cathode and a plurality of spaced-apart electrodes having substantially aligned apertures therethrough for generating and directing three electron beams along paths toward said screen, each of said electrodes being secured to a plurality of longitudinally extending insulative support rods by at least two oppositely disposed, integral attachment means, each having a distal end, a proximal end and an appendage portion therebetween, each of said distal ends having a bifurcated portion comprising spaced-apart grasping members to facilitate attachment to said support rods, wherein the improvement comprises said distal ends of each of said attachment means of at least one of said electrodes being torsionally aligned at an acute angle relative to said longitudinally extending support rods, said angle being not greater than 45°, said grasping members being symmetrically disposed with respect to said appendage portions to minimize the bending moment of said one electrode so as to reduce spacing variations and to maintain aperture alignment between said one electrode and the adjacent electrodes.

2. The tube as defined in claim 1, wherein said distal ends of each of said attachment means of said one electrode and of one of the adjacent electrodes being torsionally aligned in an oblique direction relative to said longitudinally extending support rods to effectively increase the spacing between said distal ends of said attachment means of said one electrode and of the adjacent electrode.

3. In a color picture tube including an envelope comprising a faceplate panel and a tubular neck interconnected by a funnel, a three-color phosphor screen on an interior surface of said faceplate and a multi-apertured color selection electrode spaced from said screen, an electron gun disposed within said neck, said electron gun including three cathodes and six spaced-apart electrodes, first through sixth relative to the cathodes, having substantially aligned apertures therethrough for generating an directing three electron beams along paths toward said screen, each of said electrodes being secured to a plurality of longitudinally extending insulative support rods by at least two oppositely disposed, integral attachment means, each having a distal end, a proximal end and an appendage portion therebetween, each of said distal ends having a bifurcated portion comprising spaced-apart grasping members to facilitate attachment to said support rods, wherein the improvement comprises said distal ends of each of said attachment means of at least the third and forth electrodes being torsionally aligned at an acute angle relative to said longitudinally extending support rods, said acute angle being not greater than 45°, said grasping members being symmetrically disposed with respect to said appendage portions to minimize the bending moment of said third and fourth electrodes so as to reduce the spacing variations and to maintain aperture alignment between the third and fourth electrodes and the adjacent electrodes.

4. In an electrode gun including at least one cathode and a plurality of spaded-apart electrodes having substantially aligned apertures therethrough for generating and directing at least one electron beam toward said screen, each of said electrodes being secured to a plurality of longitudinally extending insulative support rods by at least two integral attachment means, each having a distal end, a proximal end and an appendage portion therebetween, each of said distal ends having a bifurcated portion comprising spaced-apart grasping members to facilitate attachment to said support rods, wherein the improvement comprises said distal ends of each of said attachment means of at least one of said electrodes being torsionally aligned at an acute angle relative to said longitudinally extending support rods, said acute angle being not greater than 45°, said grasping members being symmetrically disposed with respect to said appendage portions to minimize the bending moment of said one electrode so as to reduce spacing variations and to maintain aperture alignment between said one electrode and the adjacent electrodes.

5. The gun as defined in claim 4, wherein said distal ends of each of said attachment means of said one electrode and of the adjacent electrode being torsionally aligned in an oblique direction relative to said longitudinally extending support rods to effectively increase the spacing between said distal ends of said attachment means of said one electrode and of the adjacent electrode.

* * * * *

UNITED STATES PATENT AND TRADEMARK OFFICE
CERTIFICATE OF CORRECTION

PATENT NO. : 4,992,698

DATED : February 12, 1991

INVENTOR(S) : Carl L. Lundvall, II

It is certified that error appears in the above-identified patent and that said Letters Patent is hereby corrected as shown below:

Col. 2, line 5, change
"that/in" to --that, in--.

Col. 3, line 31,
after "neck" add --14--.

Col. 4, line 10, change
"substrate" to --substrates--.

Col. 5, line 24, after
"twisted" add --,--.

Col. 5, line 35,
after "electrode" add --,--.

Col. 5, line 53,
after "mm" add --(--.

UNITED STATES PATENT AND TRADEMARK OFFICE
CERTIFICATE OF CORRECTION

PATENT NO. : 4,992,698

DATED : February 12, 1991

INVENTOR(S) : Carl L. Lundvall, II

It is certified that error appears in the above-identified patent and that said Letters Patent is hereby corrected as shown below:

Col. 5, line 56,
after "80kV" add --,--.

Col. 6, line 23,
change "cathode" to "cathodes--.

Col. 6, line 62,
change "an" to --and--.

Signed and Sealed this

Fourteenth Day of July, 1992

*Attest:*

*Attesting Officer*

DOUGLAS B. COMER

*Acting Commissioner of Patents and Trademarks*